US007168699B2

(12) United States Patent
Schäfer et al.

(10) Patent No.: US 7,168,699 B2
(45) Date of Patent: Jan. 30, 2007

(54) SHEET-PROCESSING MACHINE WITH A SHEET BRAKE

(75) Inventors: Thomas Schäfer, Heidelberg (DE); Frank Gunschera, Nussloch (DE); Carsten Kelm, Ketsch (DE); Sven Kerpe, Eggenstein-Leopoldshafen (DE); Ralf Steinmetz, Edingen (DE); Ralf Wadlinger, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 174 days.

(21) Appl. No.: 10/735,232

(22) Filed: Dec. 12, 2003

(65) Prior Publication Data

US 2004/0124579 A1 Jul. 1, 2004

(30) Foreign Application Priority Data

Dec. 12, 2002 (DE) ..... 102 58 001

(51) Int. Cl.
*B65H 29/68* (2006.01)

(52) U.S. Cl. ..... 271/183; 271/182; 101/232

(58) Field of Classification Search ..... 271/183, 271/182; 101/232
See application file for complete search history.

(56) References Cited

U.S. PATENT DOCUMENTS 2,521,881 A * 9/1950 Suomi ..... 346/33 B
2,670,955 A * 3/1954 Strecker ..... 271/202
2,924,453 A * 2/1960 Peyrebrune ..... 271/182
3,542,362 A * 11/1970 Friedrich et al. ..... 271/202
3,998,141 A * 12/1976 Hsiue ..... 414/789.1
4,569,514 A 2/1986 Holtje
4,830,355 A * 5/1989 Jeschke ..... 271/183
5,001,498 A * 3/1991 Shimizu et al. ..... 347/215
5,221,079 A 6/1993 Most et al.
5,265,861 A * 11/1993 Schaffner et al. ..... 271/182
5,358,233 A 10/1994 Ganter

FOREIGN PATENT DOCUMENTS

DE 35 21 324 A1 2/1986
DE 36 34 400 C2 4/1988
DE 41 16 510 A1 12/1991
DE 41 19 511 A1 12/1992
DE 42 21 927 A1 1/1994
DE 44 35 988 A1 4/1996

* cited by examiner

*Primary Examiner*—Patrick Mackey
*Assistant Examiner*—Thomas Morrison
(74) *Attorney, Agent, or Firm*—Laurence A. Greenberg; Werner H. Stemer; Ralph E. Locher

(57) ABSTRACT

A sheet-processing machine includes a conveyor for transporting processed sheets at a processing speed and for releasing the sheets for braking to a depositing speed. A braking element serves for the braking of the released sheets to the depositing speed. A drive is provided for the braking element, and a drive connection is provided for connecting the drive to the braking element. Further included are an overrunning clutch in the drive connection, and a brake for retarding the braking element.

4 Claims, 6 Drawing Sheets

SHEET-PROCESSING MACHINE WITH A SHEET BRAKE

BACKGROUND OF THE INVENTION

FIELD OF THE INVENTION

The invention relates to a sheet-processing machine, in particular a rotary printing press. The machine has a conveyor for transporting processed sheets at a processing speed and for releasing the sheets for braking to a depositing speed. A braking element serves to brake the released sheets to the depositing speed. The machine further includes a drive for the braking element, and a drive connection for connecting the drive to the braking element.

A machine of the foregoing type is disclosed, for example, in German published non-prosecuted patent application DE 40 17 931 A1. In order to achieve an adequate braking effect with the braking element disclosed therein, it is necessary for the web speed of the braking element to be considerably lower than the aforementioned processing speed. During the retardation of the sheets from the processing speed to a depositing speed, which ideally corresponds to the web speed of the braking element, there is slippage between the respective sheet and the braking element until the sheet has reached the web speed of the braking element. This slippage, on the one hand, restricts or limits the achievable braking force to the frictional force prevailing at a given vacuum in order to attract the sheets to the braking element by suction and at a given geometry of the braking element and at sliding friction, the frictional force acting upon the sheet from the braking element and, on the other hand, can result in marking of the sheets by the braking elements.

Also known are sheet brakes provided with braking elements which have a non-uniform web speed so that, in a phase wherein a respective sheet is accepted from a conveyor, in particular gripper bars which revolve and drag the sheets, the web speed of the braking elements corresponds to the web speed of the conveyor and, after acceptance has taken place, falls to a considerably lower value. A sheet brake of this type is disclosed, for example, in the German Published Non-prosecuted Patent Application DE 44 25 988 A1. Therewith, although the undesired effects of slippage between braking element and sheet can be counteracted, drives with high dynamics are required in order to change the web speed of the braking elements in a manner suitable for the process in modern high-speed machines, i.e., amongst others, in very short time intervals, in particular after the sheets have been braked.

SUMMARY OF THE INVENTION

It is accordingly an object of the invention to provide a sheet processing machine with a sheet brake wherein the machine cited at the introduction hereto is configured in a manner that an occurrence of slippage between sheet and braking element during retardation of the sheets is counteracted.

With the foregoing and other objects in view, there is provided, in accordance with the invention, a sheet-processing machine, comprising a conveyor for transporting processed sheets at a processing speed and for releasing the sheets for braking to a depositing speed, a braking element serving for the braking of the released sheets to the depositing speed, a drive for the braking element, and a drive connection for connecting the drive to the braking element, and further comprising an overrunning clutch in the drive connection, and a brake for retarding the braking element.

In accordance with another feature of the invention, the braking element comprises an endless suction belt perforated with suction openings and being revolvable during operation, the suction belt having a braking strand, and a suction box provided with a braking surface formed with suction openings and being able to be swept over by the braking strand.

In accordance with a further feature of the invention, the machine further comprises a brake provided in addition to the braking surface for temporarily retarding the braking element.

In accordance with an added feature of the invention, the braking element is constructed in the form of a rotational body.

In accordance with an additional feature of the invention, the rotational body constitutes a suction ring.

In accordance with an alternative feature of the invention, the rotational body constitutes a suction roller.

In accordance with a concomitant feature of the invention, the drive connection is severable.

In the first-mentioned configuration of the invention, the braking element is thus able to overrun the drive in a first phase of the interaction or cooperation of sheet and braking element, due to the provision of the overrunning clutch in the drive connection. In this phase, the sheet oncoming to the braking element at processing speed contacts a contact surface section of the braking element which, until the first contact with the sheet, has a web speed impressed onto the braking element by the drive, which is considerably lower than the processing speed with which the conveyor supplies the sheets to the braking element. After this first contact has been produced, due to the difference between the processing speed inherent in the sheet and the web speed impressed upon the braking element by the drive, the contact effects an acceleration of the braking element.

In a preferred configuration, this acceleration takes place in an operating state of the conveyor wherein the latter has not yet released the sheet so that it can be braked, i.e., has not yet transferred the sheet to the braking element. The section of the sheet located between the conveyor and the braking element is therefore subjected to tension or tautened in an advantageous manner and, moreover, the trailing end of the sheet is prevented from being folded over, which would otherwise occur if the sheet were previously released by the conveyor during the acceleration of the braking element. The release of the sheet by the conveyor is therefore preferably carried out at the end of the acceleration phase, i.e., at an instant of time at which the web speed of the braking element corresponds to the processing speed. Beginning from this instant of time, the brake provided for retarding the braking element then carries out the proper action thereof.

At the end of the aforementioned acceleration phase, static friction exists between the braking element and the sheet, so that the aforementioned brake retards the braking element together with the sheet adhering thereto. In this regard, however, no slippage occurs between the sheet and the braking element.

In the simplest case, only a passively acting brake is provided for retarding the braking element, and serves for retarding the latter automatically and, at most, down to the web speed which is prescribed by the drive. This will be further explained hereinbelow in greater detail. Further features of the subject of the invention and of the configurations thereof may be derived from the appended drawings and the following explanations referring thereto, which are based upon a sheet-processing rotary printing press.

Other features which are considered as characteristic for the invention are set forth in the appended claims.

Although the invention is illustrated and described herein as embodied in a sheet-processing machine with a sheet brake, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
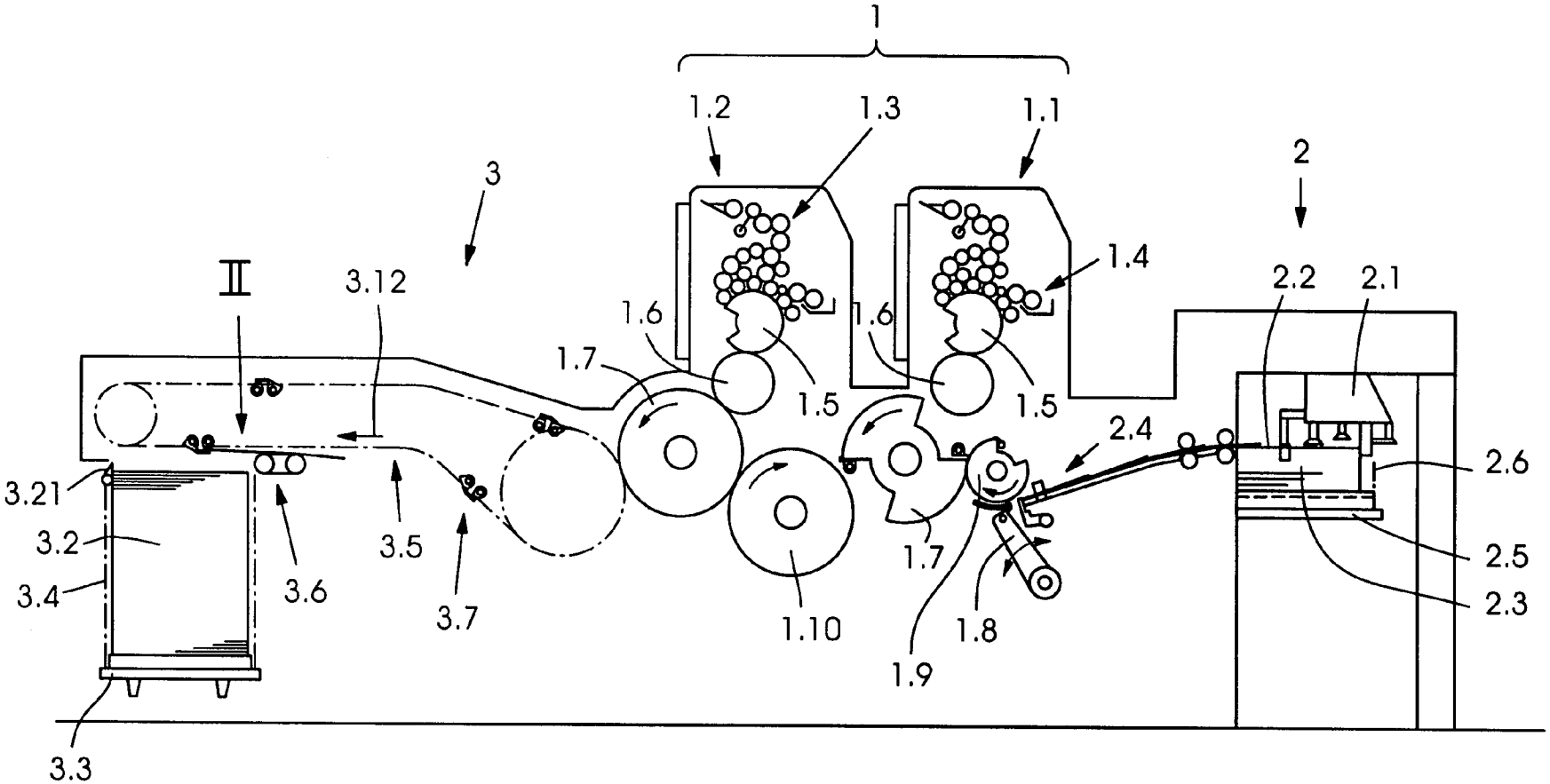
FIG. 1 is a diagrammatic side elevational view of a sheet-processing rotary press equipped with a sheet brake according to the invention in a braking station.

Referring now to the drawings and, first, particularly to FIG. 1 thereof, there is shown therein diagrammatically a sheet-processing rotary printing press having a press section 1 with, for example, two processing stations in the form of printing units 1.1 and 1.2, so that two colors can be printed therewith. For each further color, a further printing unit has to be provided. For further process steps, such as varnishing, intermediate drying, perforating and so on, respectively, a further processing station has to be provided. In the case illustrated by way of example, the printing units 1.1 and 1.2 operate in accordance with the wet offset process and, accordingly, each thereof has an inking unit 1.3 and a dampening unit 1.4, a plate cylinder 1.5 connected thereto, a blanket cylinder 1.6 rolling on the latter during operation, and an impression cylinder 1.7 for guiding a respective sheet 2.2.

For loading the printing units 1.1 and 1.2 with the sheets 2.2, a feeder 2 is provided which, by a separating or singling device 2.1, picks a respective topmost sheet 2.2 off a stack or pile 2.3 and transfers it to a transport and alignment device 2.4 which aligns a respective sheet on leading edge stops and on at least one side stop, the sheet leading in the process direction and being separated to form an overlapping or imbricated formation, after transport thereof in a direction towards the leading edge stops, the transport being performed in particular by a suction belt table.

An oscillating pregripper 1.8, here assigned to the printing unit 1.1 and belonging to the first processing station, picks up the respectively aligned sheet 2.2 and transfers the latter to a feeder drum 1.9 which, in turn, transfers it to the impression cylinder 1.7 of the printing unit 1.1. After the sheet 2.2 has passed through the printing nip of this printing unit 1.1, the impression cylinder 1.7 of the latter transfers the sheet 2.2 to a transfer device in the form of a sheet-guiding drum 1.10 located between the impression cylinders 1.7 of the two printing units 1.1 and 1.2. In the case of a printing press constructed for recto and verso printing, a sheet reversing or turning device which can be changed or converted between recto printing operation and recto and verso printing operation is provided instead. The impression cylinder 1.7 of the printing unit 1.2 picks up the sheet 2.2 from the sheet-guiding drum 1.10, guides it through the further printing nip and then transfers it to a conveyor 3.5, which is arranged in a delivery 3, transports the sheet 2.2 along a conveying section in a conveying direction at the processing speed and, after the sheet 2.2 has passed the conveying section, transfers the sheet 2.2 to a sheet brake 3.6 for braking it to a depositing speed, the sheet brake 3.6 ultimately releasing the sheets 2.2 in order to form a printed-material stack or pile 3.2.

The conveyor 3.5 is equipped with gripper bars 3.7, whereon grippers are arranged which are normally closed under spring force and, upon rotation of a gripper shaft carrying the grippers, the rotation being effected by a cam follower arrangement disposed on the latter and a gripper opening cam deflecting the latter appropriately as the cam passes the latter, are temporarily opened, a phase which is not illustrated.

In production printing, the production level at the pile or stack 2.3 in the feeder 2, i.e., the upper height or vertical position of the respective topmost sheet 2.2, and the drop height in the delivery 3 of the sheets 2.2 released by the conveyor 3.5, are maintained by appropriate tracking of respective platforms 2.5 and 3.3 carrying the pile or stack 2.3 and the printed-product pile or stack 30.2, respectively, by respective lifting units, of which only lifting chains 2.6 and 3.4 carrying the platforms 2.5 and 3.3 are represented in phantom.

In the configuration shown in FIG. 1, the sheet brake 3.6 represents a suction belt brake. In the case of a first embodiment thereof, it has suction belts which are transverse to the processing direction and, during operation, preferably revolve successively or after one another with adjustable mutual spacings at a speed which is lower than the processing speed, while, in a preferred second embodiment of the suction belt brake, a single suction belt is provided. The latter is then placed in the longitudinal center of the machine and has an extent in the transverse direction which is matched to the smallest possible format of the sheets which can be processed by the machine. This second embodiment can advantageously be used in a machine operating in accordance with the recto printing process and provides the possibility of large-area suction contact with the sheets to be retarded, so that an adequate braking force can be achieved with a moderate suction action on the suction belt.

Figure 3:
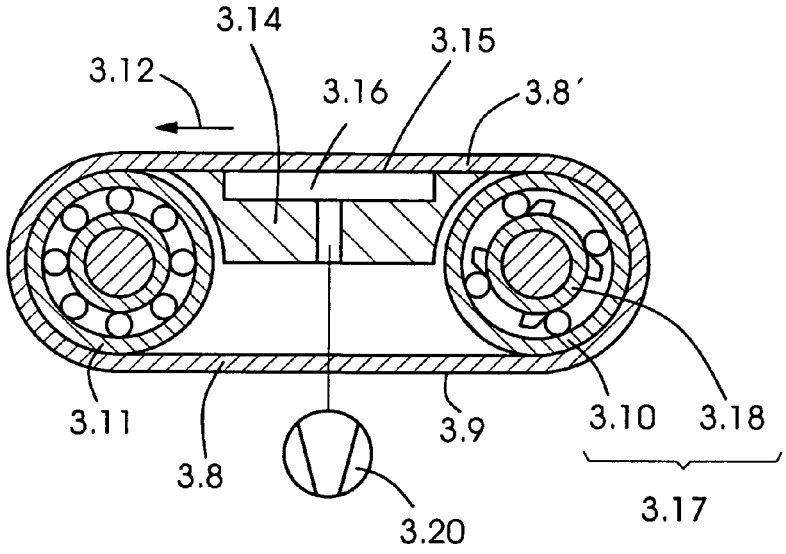
FIG. 3 is a sectional view of FIG. 2, taken along the line III—III in the direction of the arrows.
Figure 2:
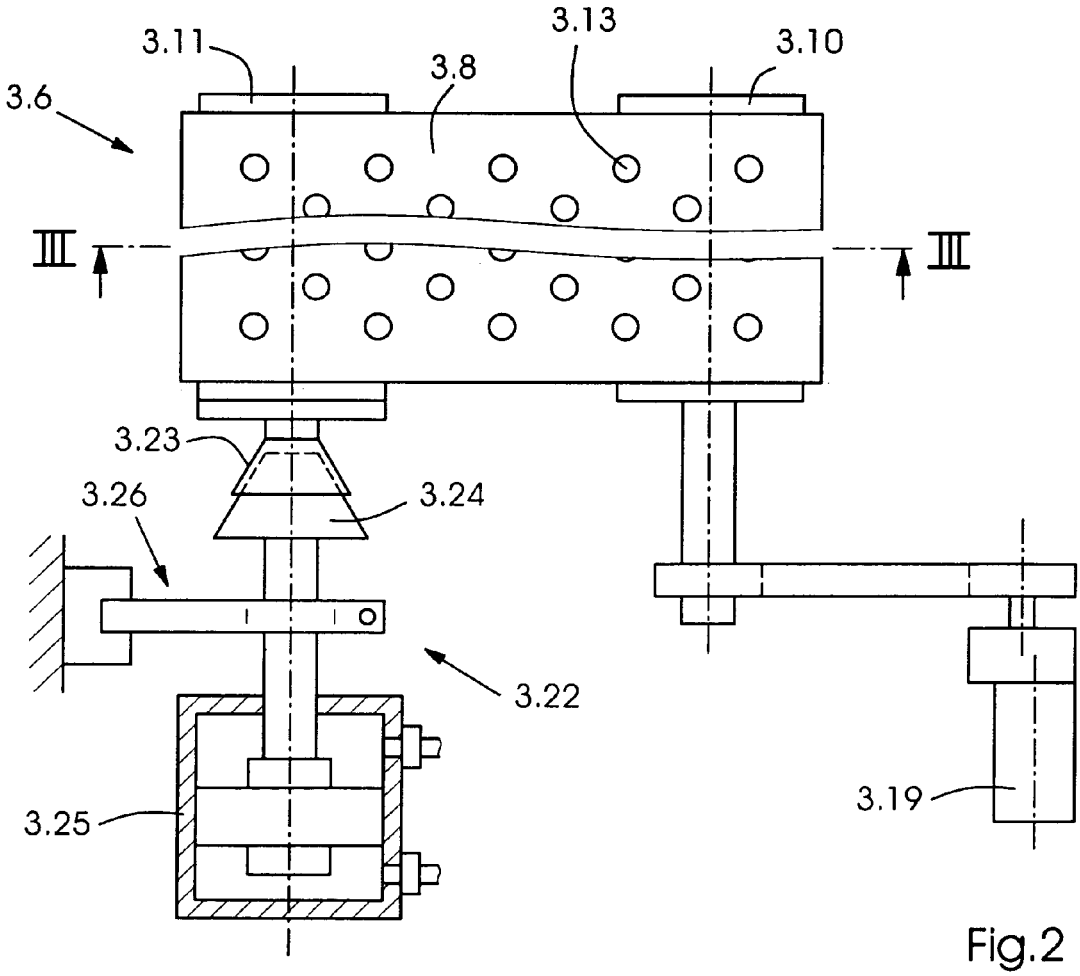
FIG. 2 is an enlarged, simplified fragmentary plan view, partly in section, of FIG. 1 showing the sheet brake, as viewed in the direction of the arrow II in FIG. 1, the sheet brake being constructed in the form of a suction belt brake.

As is believed to be apparent from FIGS. 2 and 3, the sheet brake 3.6, in the case wherein it is constructed as a suction belt brake, includes a braking element in the form of an endless suction belt 3.8 which revolves during operation and has an outer side representing an intrinsically closed contact surface 3.9. The suction belt 3.8 wraps around a drive roller 3.10 and a deflection roller 3.11 and, therefore, forms a tensioning-member drive with a braking strand 3.8' moved in the running or travel direction represented by the directional arrow 3.12 (note also FIG. 1). The braking strand 3.8' forms a contact surface section of the contact surface 3.9. For the case wherein a single suction belt with the aforementioned transverse extent matched to the smallest possible format of the sheets is provided, the single suction belt preferably wraps around other appropriate rollers instead of drive and deflection rollers. The suction belt 3.8 is formed with suction openings 3.13 and, during operation, sweeps over a supporting surface which is formed on a suction box 3.14 and, as explained hereinafter, represents a braking surface 3.15, wherein there are formed suction openings 3.16 which communicate with a diagrammatically illustrated vacuum generator 3.20, the suction openings 3.16 being here formed by grooves, by way of example, which connect the suction openings 3.13 belonging to the suction belt 3.8, which are located in the area of the suction openings 3.16 formed in the braking surface 3.15 of the suction box 3.14, fluidically to the aforementioned vacuum generator 3.20. To this extent, in the contact surface section formed on the braking strand 3.8', the sheet brake 3.6 makes contact with a respective sheet 2.2 brought up to the sheet brake 3.6 at the processing speed by the conveyor 3.5, under the action of a vacuum which acts through the suction openings 3.13.

The drive roller 3.10 around which the braking element in the form of the suction belt 3.8 is wrapped forms an outer ring of an overrunning clutch 3.17, an inner ring 3.18 of which has a drive connection to a drive which produces a uniform rotational movement and, in the case at hand, is represented by a geared motor 3.19. Overall, the braking element in the form of the suction belt 3.8 therefore has a drive connection via an overrunning clutch to a drive producing a uniform rotational movement. The drive is of such construction that a web speed which is lower than the processing speed is impressed upon the suction belt 3.8.

The braking surface 3.15 supporting the braking run 3.8' is in frictional contact with the braking run 3.8' during operation, in particular due to the suction acting upon the braking strand 3.8' through the suction openings 3.16, here formed as grooves therein, and therefore exerts a braking action on the braking strand 3.8'.

If, then, following the aforedescribed acceleration to the processing speed of the braking element formed as the suction belt 3.8 on the part of the sheet 2.2 supplied to the latter at the processing speed, the transfer of the sheet 2.2 to the sheet brake, i.e., the release of the sheet by the conveyor 3.5, is performed, the aforedescribed frictional contact then retards the braking element, namely the suction belt 3.8 here, under a normal force brought about by the aforementioned suction, and therefore retards the sheet 2.2 sucked against the belt. The suction box 3.14, to this extent, forms a brake for retarding the braking element constructed in the form of the suction belt 3.8.

The brake formed, to this extent, by the suction box 3.14 engaging with the braking element acts uninterruptedly during the operation of the sheet brake 3.6, and this action necessarily results, assuming proper use of the sheet brake 3.6, so that the suction box 3.14 represents a passively acting brake for retarding the braking element, as already indicated hereinbefore. A retardation of the braking element results from this braking action, however, only until the braking element, following the preceding acceleration thereof by a sheet 2.2, has fallen to the web speed again, which the drive, here the geared motor 3.19, impresses upon the suction belt 3.8 representing the braking element.

The construction of the sheet brake in the form of a suction belt brake, as illustrated by way of example in FIGS. 2 and 3, therefore proves to be advantageous inasmuch as, in this regard, the brake for retarding the braking element, namely the suction belt 3.8 here, is already implied.

The aforedescribed acceleration and braking operations proceed periodically at the frequency of the sequence of the sheets 2.2 transferred to the sheet brake 3.6 by the conveyor 3.5.

Figure 4:
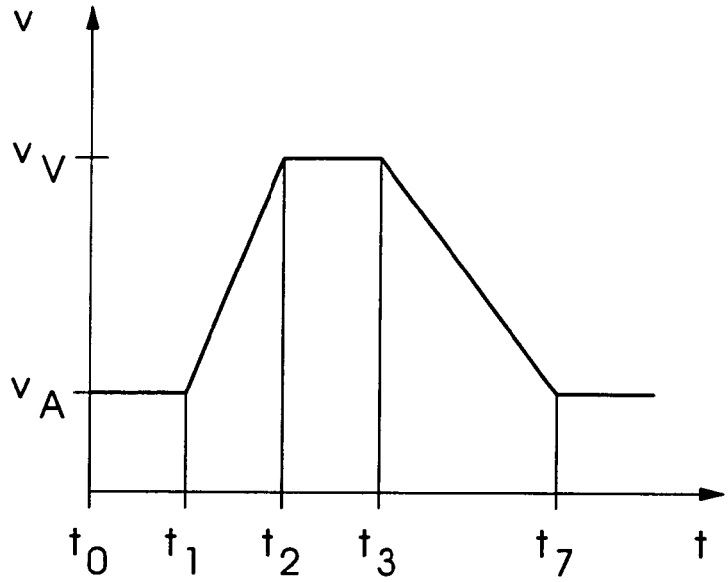
FIG. 4 is a plot diagram depicting qualitatively a period of the process performed in the braking station by the sheet brake for the case of an only passively acting brake for retarding the braking element of the sheet brake.

In a plot diagram in FIG. 4, the change in the web speed of the braking element formed as the suction belt 3.8 is reproduced qualitatively for one of the periods. In this regard, the start of the period is set arbitrarily at a time to, at which a sheet 2.2 transported at the processing speed by the conveyor 3.5 still has no contact with the braking strand 3.81', the web speed of which has the magnitude $v_A$ impressed thereon by the drive. At an instant of time $t_1$ following the starting instant $t_0$, it is assumed that the contact between a sheet 2.2 and the braking strand 3.8' is then produced, i.e., this sheet 2.2 has pounced on the sheet brake 3.6. From this time $t_1$ onward, the sheet 2.2 still always transported at the processing speed $v_V$ by the conveyor 3.5, i.e., by the grippers of one of the gripper bars 3.7, accelerates the braking element, here the suction belt 3.8, to the processing speed $v_V$, which is reached at the instant of time $t_2$, for example.

During this process, the braking element, i.e., the suction belt 3.8, overruns the drive due to the overrunning clutch 3.17 used in the drive connection thereof to the drive in the form of the geared motor 3.19. At an instant of time $t_3$ following the instant of time $t_2$, the conveyor 3.5 transfers the sheet 2.2 to the sheet brake 3.6, i.e., the grippers of the aforementioned gripper bar 3.7 release the sheet 2.2 and, from this time on, the suction box 3.14, more precisely the supporting surface 3.15 thereof, acts upon the suction belt 3.8 for retarding the latter, and consequently also upon the sheet 2.2 which is sucked against the suction belt 3.8, until the web speed of the suction belt 3.8 has fallen again to the speed which is impressed thereon by the drive, here the geared motor 3.19. It is assumed that this is the case at the instant of time $t_7$.

From this instant of time $t_7$ on, the sheet 2.2 sucked onto the braking element is conveyed onwardly by the braking element at the web speed $v_A$ impressed on the braking element by the drive, until the sheet 2.2 finally leaves the braking element, in fact at the web speed $v_A$ present from the instant of time $t_7$, which is thus also the horizontal component of the deposition speed, while the sheet 2.2 moves in the direction towards leading edge stops 3.21 (note FIG. 1), falling at the same time, in order to be aligned with the printed material pile or stack 3.2.

In the case wherein a sheet brake is constructed in the form of a suction belt brake, the brake to be provided for the described intended operation thereof for retarding the braking element which is in the form of the suction belt 3.8 could in principle remain restricted to the described passively acting brake which is in the form of the supporting surface 3.15 acting as a braking surface.

As indicated in FIG. 2, however, an actively acting brake 3.22 for retarding the braking element is preferably also provided in this case. In this exemplary embodiment, the brake is assigned to the deflection roller 3.11. In another configuration, it can instead be assigned to the drive roller 3.10 or both the drive roller 3.10 and the deflection roller 3.11 can each have a respective brake assigned thereto.

In the exemplary configuration according to FIG. 2, a hollow braking cone 3.23 is flange-mounted endwise to the deflection roller 3.11. Fitted into the cone 3.23 is a braking cone 3.24, which represents a piston-rod head of a double-acting piston-cylinder arrangement 3.25 having a torque support 3.26. The mode of action of the brake 3.23, which here, by way of example, can be actuated by a double-acting braking cylinder, is believed to be obvious and is therefore not further described herein. However, by the actively acting brake 3.22, different sequences of the process of retarding the sheets 2.2 from the processing speed $v_V$ to the aforementioned depositing speed $v_A$ can be performed, each of which, however, also requires control of the actively acting brake 3.22. In this regard, the control should, amongst others, also preferably ensure that the drive does not be braked by the brake 3.22.

Figure 5:
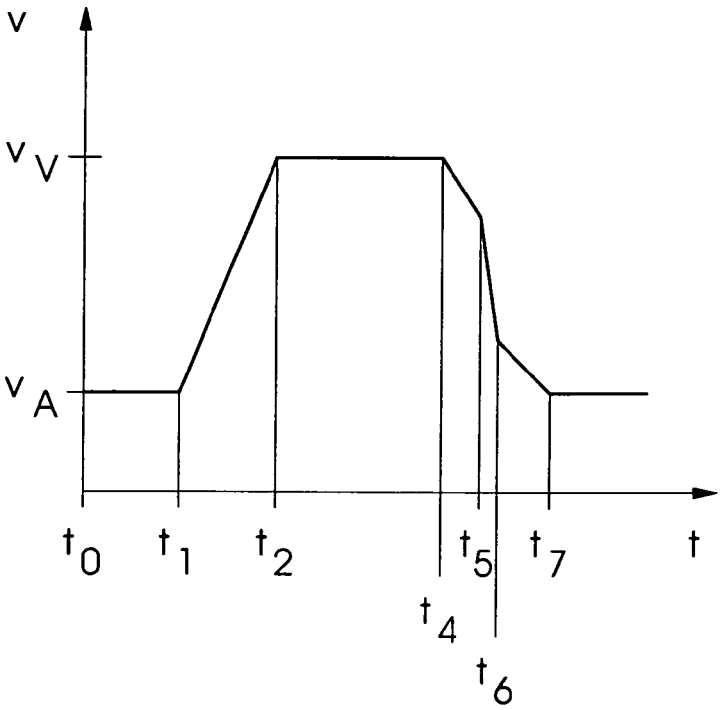
FIG. 5 is a plot diagram corresponding to that of FIG. 4 for the case wherein the brake also has an active component for retarding the braking element.

In a plot diagram shown in FIG. 5, an example of the sequence of the process of retarding the sheets 2.2 from the processing speed $v_V$ to a depositing speed $v_A$ is reproduced qualitatively for the case wherein the sheet brake constructed in accordance with FIGS. 2 and 3 is additionally equipped with an actively acting brake, here in the form of the aforedescribed brake 3.22. This process again proceeds, as mentioned, within one period of the periodic acceleration and retardation operations.

As is believed to be apparent from FIG. 5, the course of the web speed of the braking element in the form of the suction belt 3.8 coincides with that according to FIG. 4 up to the instant of time $t_2$. Because, with the additional actively acting brake 3.22, more rapid braking of the braking element is possible than without the brake 3.22, the respective sheet 2.2 can be released for braking by the grippers of a corresponding gripper bar 3.7 at an instant of time $t_4$ which is later than the instant of time $t_3$ according to FIG. 4. From this time on, the passively acting brake in the form of the supporting surface 3.15 is again active, i.e., the web speed of the braking element decreases without further measures and, under the same operating conditions as in the case of FIG. 4, to the same extent until the brake 3.22 becomes active, as indicated qualitatively in FIG. 4. From the instant of time $t_5$, however, the actively acting brake 3.22 is actuated with the effect of retarding the braking element, here the suction belt 3.8, and, in fact, in the case of the course of the web speed of the braking element reproduced by way of example in FIG. 5, until an instant of time $t_6$, at which, although the web speed of the braking element has not yet fallen to the desired depositing speed $v_A$, it has reached a magnitude from which the passively acting brake in the form of the supporting surface 3.15 is capable of retarding the braking element, i.e., the suction belt 3.8, to the depositing speed $v_A$ until the instant of time $t_7$ according to FIG. 4 is reached.

Whereas, during the retardation of the braking element, which is carried out in accordance with FIG. 5, the brake 3.22 acts together with the passively acting brake in the form of the supporting surface 3.15 only in a section of the braking operation which lasts from the time $t_4$ to the time $t_7$, the supporting surface and the brake 3.22 can also be acting together during the entire braking operation. In this case, the result is a shorter braking period than that which can be seen in FIG. 5 in the form of the time section between $t_4$ and $t_7$, so that the respective sheet 2.2 can be released by the grippers of a corresponding gripper bar 3.7 to be braked at a time later than specified by $t_4$ in FIG. 5.

The exemplary embodiment outlined in FIGS. 2 and 3 represents only one type of sheet brake according to the invention, in fact with regard to the construction of the braking element in the form of a suction belt which revolves during operation. In addition, the arrangement and configuration of the overrunning clutch 3.17 and of the brake 3.22 are only exemplary. A type deviating therefrom has a braking element in the form of a rotational body.

Figure 6:
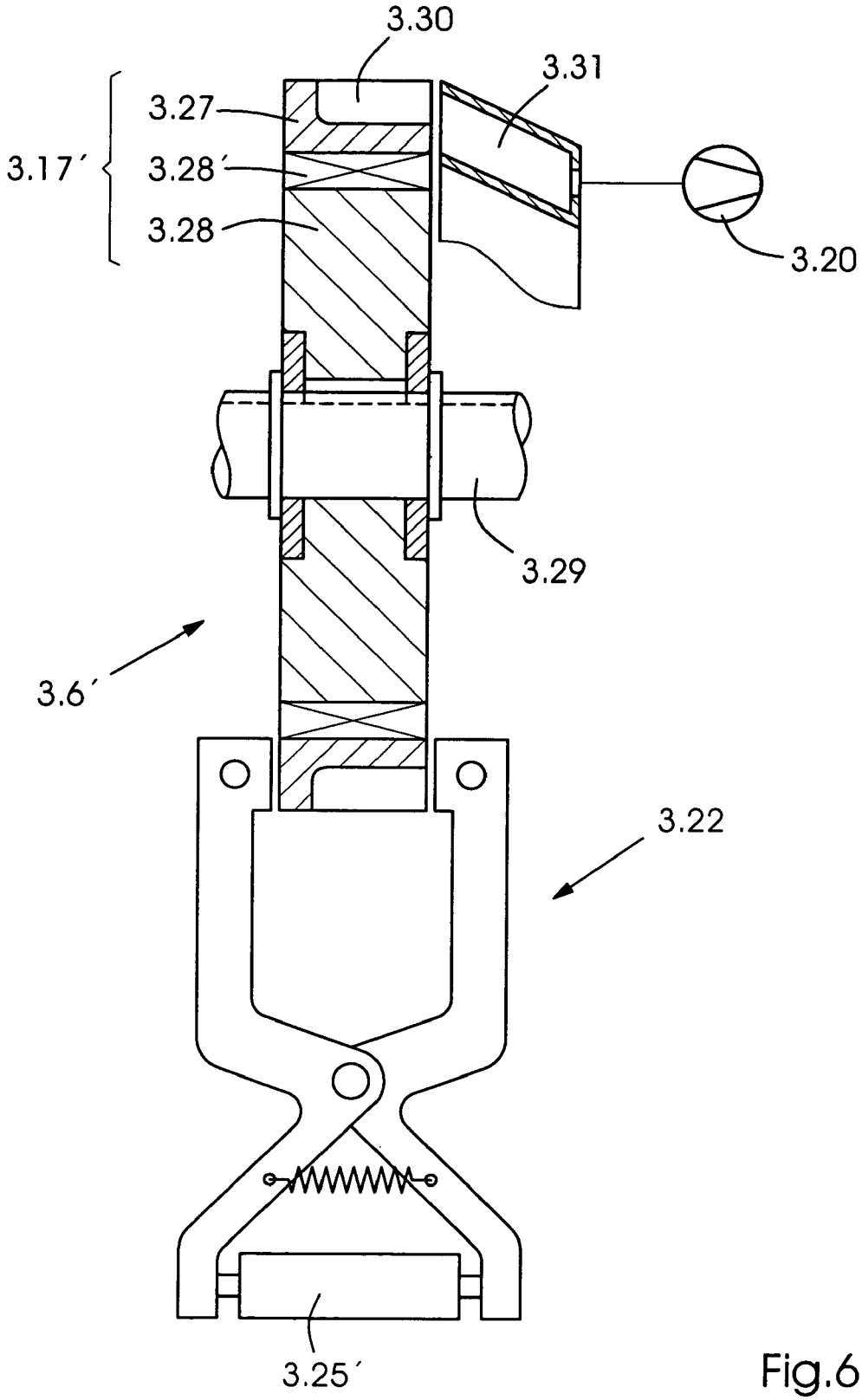
FIG. 6 is a simplified sectional view of an alternative configuration of the sheet brake with a braking element formed as a suction ring and an actively acting brake for retarding the braking element.

In the exemplary embodiment illustrated diagrammatically in FIG. 6, a braking element is provided in the form of a rotational body which forms a suction ring 3.27 and which, by way of example, simultaneously represents an outer ring of an overrunning clutch 3.17', the inner ring of which forms a drive pulley 3.28 which is firmly mounted on a drive shaft 3.29 so as to rotate therewith. The overrunning clutch 3.17' further includes rolling elements arranged between the suction ring 3.27 and the drive pulley 3.28 which, in a manner analogous to that of the rolling elements which are believed to be apparent from FIG. 3 and thereat act between the drive roller 3.10 and the inner ring 3.18, cooperate with the cylindrical inner surface of the suction ring 3.27 and a corresponding cross-sectional profile of the drive pulley 3.28.

The suction ring 3.27 is formed, on the circumference thereof, with suction slots 3.30 which open into or terminate in one end of the suction ring 3.27. In a sector of the suction ring 3.27 which faces towards the sheet 2.2 to be braked, a suction chamber 3.31 open toward the aforementioned end is arranged in the immediate vicinity of the suction ring 3.27. The suction chamber 3.31 is, for example, connected to the hereinaforementioned vacuum generator 3.20.

For the purpose of retarding the braking element present here in the form of the suction ring 3.27, provision is made for a brake 3.22' in the form of a caliper brake or shoe brake which can be set against the braking element and which is shown only diagrammatically, as is a piston-cylinder arrangement 3.25' serving for the actuation thereof.

Figure 7:
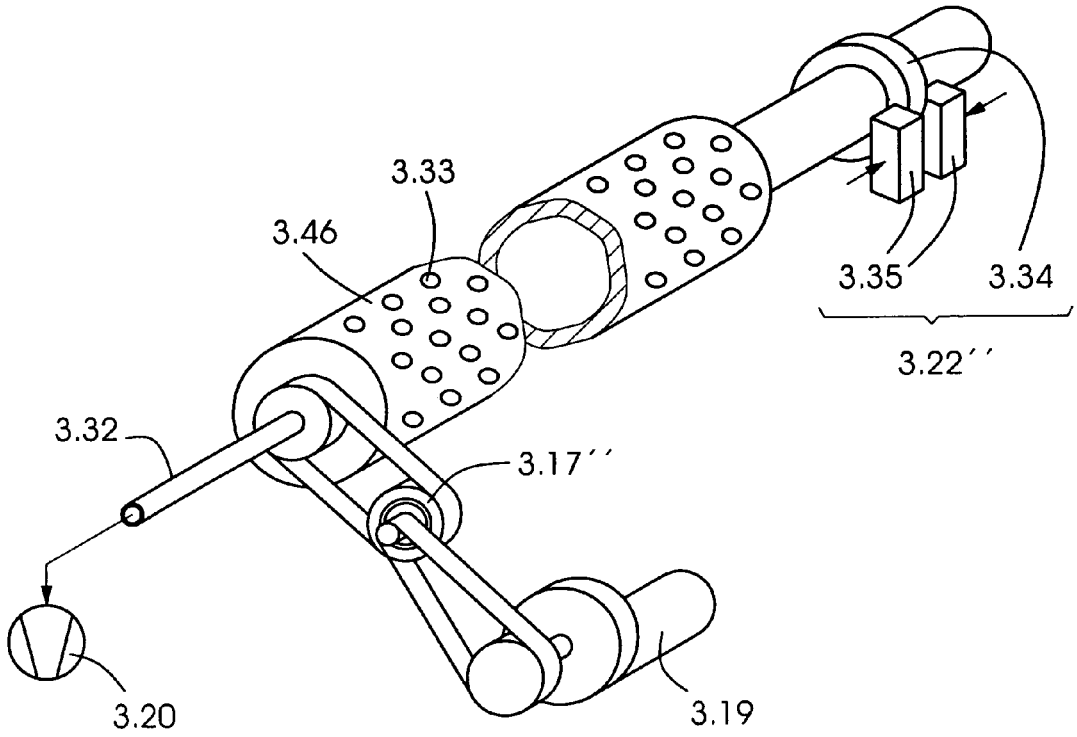
FIG. 7 is a simplified perspective view of another alternative configuration of the sheet brake with a braking element formed as a suction roller and an actively acting brake for retarding the braking element.

In the exemplary embodiment illustrated diagrammatically in FIG. 7, a braking element is provided in the form of a rotational body forming a suction roller 3.46. The suction roller 3.46 is mounted in a manner not otherwise specifically illustrated so that it can rotate freely and is constructed in the form of a hollow roller into which, at an end thereof, a stationary suction pipe 3.32 projects, with respect to which the suction roller 3.46 is sealed off in a manner not otherwise specifically illustrated. The suction pipe 3.46 is connected, for example, to the vacuum generator 3.20 mentioned hereinbefore, which then communicates with the suction openings 3.33 penetrating the circumferential shell of the suction roller 3.46.

Between the suction roller 3.46 and a drive, for example the geared motor 3.19 mentioned hereinbefore, there is a drive connection, into which an overrunning clutch 3.17" is inserted.

Firmly connected to the suction roller 3.46 so as to rotate therewith is a brake ring 3.34, against the ends of which caliper brakes or shoe brakes 3.35 which can be actuated in a manner not otherwise specifically illustrated can be set, which then, with the brake ring 3.34, constitute a brake 3.22" for retarding the braking element, formed here as a suction roller 3.46.

In a preferred configuration, the length of the suction roller 3.46 is matched to an extent, transverse to the processing direction, of the sheets 2.2 with the smallest possible format that can be processed.

The overrunning clutch 3.17" operates, for example, in accordance with the principle of the overrunning clutch 3.17 seen in FIG. 3 and, for this purpose, includes an inner ring driven by the geared motor 3.19 and an outer ring which drives the suction roller 3.46 via a belt drive and can overrun the inner ring in the drive direction.

In an advantageous further development, the drive connection provided between the braking element and the drive can be severed.

Figure 8:
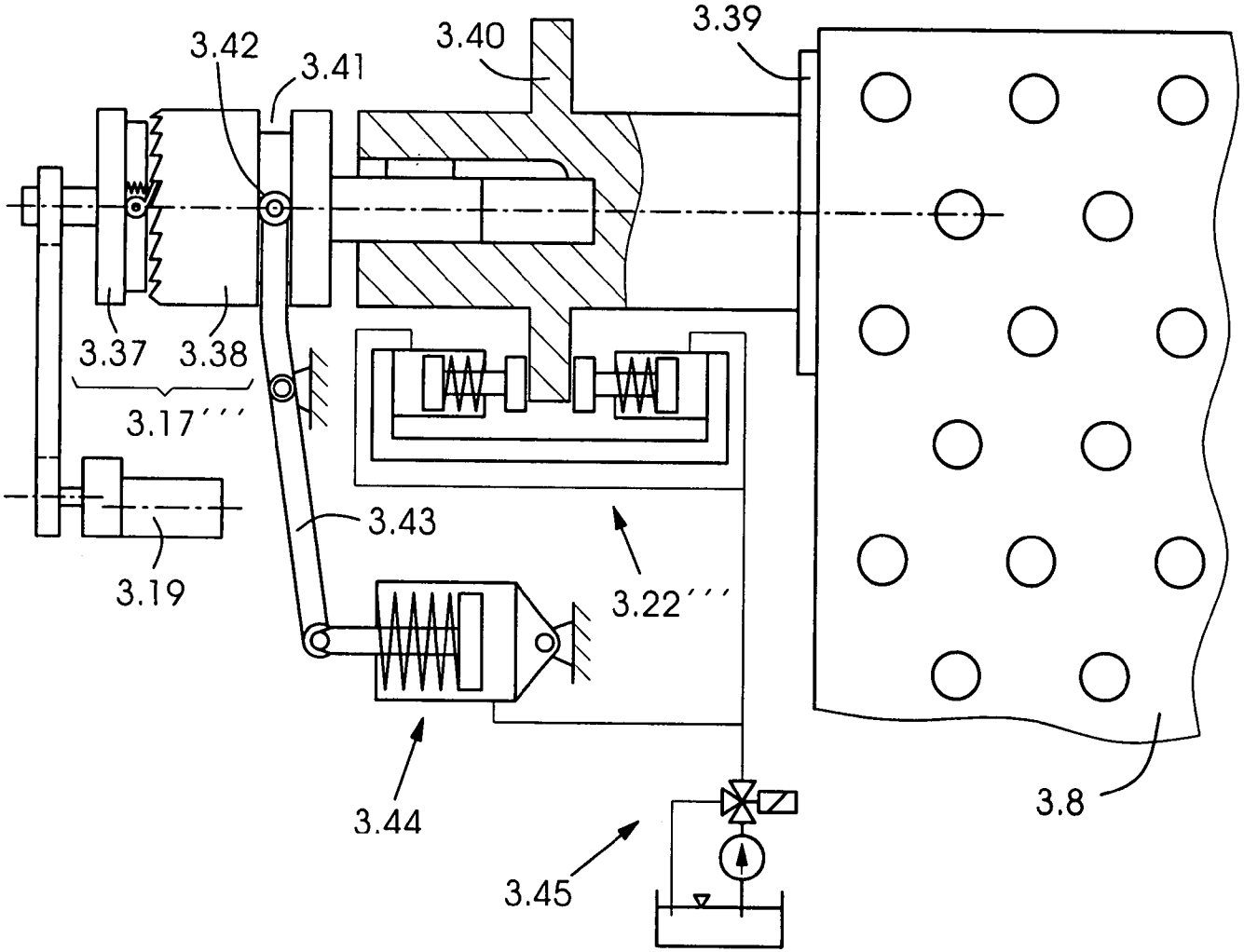
FIG. 8 is an enlarged fragmentary diagrammatic and schematic view of a further configuration of the sheet brake with a braking element having a decouplable drive.

FIG. 8 reproduces diagrammatically an example of a configuration of this type, in fact for the case wherein the braking element that is used is, for example, an endless suction belt which revolves during operation, such as the suction belt 3.8 according to FIG. 2, for example.

The drive is again formed, for example, by the geared motor 3.19 mentioned hereinbefore. The latter has a drive connection to a drive part 3.37 of an overrunning clutch 3.17'", which includes a driven part 3.38 movable axially away from the drive part 3.37 and which can overrun the drive part 3.37.

The driven part 3.38 has a torque-transmitting and axially displaceable connection with a roller which guides the suction belt 3.8, such as in particular the drive roller 3.10 or the deflection roller 3.11 or, in the aforementioned case of a single suction belt matched to the smallest format of the sheets 2.2, a connection to a corresponding roller, the roller 3.39 in the example according to FIG. 8.

In order to retard the braking element, here the suction belt 3.8, a brake 3.22'" is provided, which, by way of example, is here in the form of a disk brake which is actuatable hydraulically counter to restoring forces and has a brake disk 3.40 which is firmly connected to the roller 3.39.

The driven part 3.38 is formed with a circumferential groove 3.41, on the annular surfaces of which there acts a roller 3.42 of a roller lever 3.43 which is attached or linked in a locally fixed position and which, for example by a spring-loaded, single-acting, hydraulically actuatable actuating cylinder 3.44, is pivotable between the drive, here in the form of the geared motor 3.19, with the effect of producing the drive connection, and the braking element, here in the form of the suction belt 3.8, with the effect of severing this drive connection.

The roller lever 3.43 preferably forms a fork and, respectively, carries a roller 3.42 on the legs or tines thereof.

An hydraulic system 3.45 is connected to the brake 3.22'" and to the actuating cylinder 3.44 in such a manner that the driven part 3.38 of the overrunning clutch 3.17'" is moved away from the drive part 3.37 thereof when the brake 3.22'" is actuated. This advantageously has the result that the braking element, here the suction belt 3.8, can be retarded without any reaction on the drive, here the geared motor 3.19.

Following the completion of the retardation operation, the aforementioned drive connection is produced again, so that the suction belt 3.8 now transports a respective one of the sheets 2.2 onwardly in the direction towards the printed-material stack or pile 3.2 at a depositing speed which is reduced with respect to the processing speed, this depositing speed being impressed upon the suction belt 3.8 by the geared motor 3.19.

We claim:

1. A sheet-processing machine, comprising:

a conveyor for transporting processed sheets at a processing speed and for releasing the sheets for braking to a depositing speed;

a braking element for braking the released sheets to the depositing speed, said braking element being an endless suction belt perforated with suction openings and being revolvable during operation, said suction belt having a braking strand;

a drive for said braking element; and a drive connection F or connecting said drive to said braking element, said drive connection having an overrunning clutch; and a brake for retarding said braking element, said brake being configured as a suction box provided with a braking surface with suction openings formed therein, said braking strand sweeping over said braking surface.

2. The machine according to claim 1, wherein said brake includes an actively acting brake assembly in addition to said braking surface for temporarily retarding said braking element.

3. The machine according to claim 1, wherein said drive connection is severable.

4. The sheet-processing machine according to claim 1 configured as a rotary printing press.

* * * * *